US005584742A

United States Patent [19]

Chen

[11] Patent Number: 5,584,742

[45] Date of Patent: Dec. 17, 1996

[54] ROCKING ORNAMENT IN A TRAY

[76] Inventor: Li-Heng Chen, P.O. Box 96-405, Taipei 10098, Taiwan

[21] Appl. No.: 572,129

[22] Filed: Dec. 14, 1995

[51] Int. Cl.[6] ..... A63H 5/00; A63H 13/18; A63H 29/22

[52] U.S. Cl. ..... 446/397; 446/396; 446/326; 446/484; 40/414; 84/94.2; 84/95.2

[58] Field of Search ..... 446/396, 397, 446/325, 326, 330, 484; 40/414, 423; 84/94.1, 94.2, 95.1, 95.2

[56] References Cited

U.S. PATENT DOCUMENTS

| | | | |
|---|---|---|---|
| 4,756,222 | 7/1988 | Armato | 446/397 X |
| 4,793,081 | 12/1988 | Andrae et al. | 40/414 |
| 4,869,703 | 9/1989 | Ong | 40/414 X |
| 4,901,459 | 2/1990 | Lee | 40/414 |
| 5,462,471 | 10/1995 | Power-Fardy | 40/414 X |

FOREIGN PATENT DOCUMENTS

| | | | |
|---|---|---|---|
| 518928 | 3/1955 | Italy | 84/95.1 |
| 280210 | 4/1952 | Switzerland | 84/95.2 |

*Primary Examiner*—Robert A. Hafer
*Assistant Examiner*—D. Neal Muir

[57] ABSTRACT

A rocking ornament in a tray, which comprises a tray with an ornamental pattern, and the front recess portion of the tray is mounted with a rocking member; the back side of the rocking member has an elongate slot, which is to be engaged with a stud on an eccentric wheel connected with transmission device in a mechanism chamber behind the tray; the lower part of the rocking member has a through hole for receiving a screw spindle with a shaft, and the screw spindle is to be fastened to the tray as a supporting shaft to the rocking member; the rocking member can move circularly with the stud on the eccentric wheel simultaneously upon of the transmission device in the mechanism chamber driving the eccentric wheel, and then the rocking member will sway laterally and regularly.

9 Claims, 5 Drawing Sheets

ROCKING ORNAMENT IN A TRAY

BACKGROUND OF THE INVENTION

1. Field of the Invention

This invention relates to a music box, and particularly to a rocking ornament in a tray.

2. Description of the Prior Art

In the conventional music box, the music device therein is usually mounted in a specific chamber; one side of a music drum of the music device has an extended shaft to connect with an eccentric wheel; the outer edge of the eccentric wheel is mounted with a round shaft, which is connected with a guide member having a guide slot. The guide member has an elongate shaft extended above a housing; the elongate shaft is fastened with a rocking ornament. When the music box drives the eccentric wheel to turn, the eccentric wheel will pull, through the round shaft on outer edge thereof, the guide member to move up and down so as to have the ornament above the housing to move up and down; such art has been shown in U.S. Pat. No. 5,070,753, U.S. Pat. No. 5,438,153 patent article.

SUMMARY OF THE INVENTION

The prime object of the present invention is to provide a rocking mechanism, in which the front side of a tray has a recess portion with a suitable ornamental pattern; the center of the recess portion is mounted with an ornamental rocking member, of which the lower part is mounted with a rotative shaft; the back center of the rocking ornament is furnished with an elongate slot to receive the stud on the eccentric wheel. The music box can drive the stud on the eccentric wheel to move circularly, and simultaneously the ornamental rocking member will be driven to sway laterally.

Another object of the present invention is to provide a rocking ornament, in which the recess portion of the tray is furnished with a suitable ornamental pattern. The center of the recess portion has a round hole, being in communication with the mechanism chamber on the back of the tray; the mechanism chamber is mounted with a music box, which is coupled with a driven gear through a transmission gear. The shaft of the driven gear extends into a hole in the center of the tray; the end of the shaft is connected with the eccentric wheel, of which the edge part is mounted with a stud to be engaged in the elongate slot on a round seat of the back of the rocking member; then, the rocking member can sway laterally upon the music box driving the eccentric wheel to move.

Still another object of the present invention is :to provide a rocking ornament, in which the recess portion of the tray is mounted with an ornamental rocking member; the lower part of the rocking member has a through hole for receiving a screw spindle; the other end of the screw spindle is mounted in a through hole in the lower part of the tray as a rocking shaft to support the ornamental rocking member to sway.

A further object of the present invention is to provide a rocking ornament, in which the screw spindle as a rocking shaft passes through the through hole of the rocking member, and extends at a suitable length with a smaller diameter round shaft to pass through the through hole in the tray; a stair-shaped portion is furnished between the two different shaft parts, and the stair-shaped portion is mounted with a washer; the other end of the screw spindle is mounted with a nut so as to provide the rocking member with a stable supporting shaft.

A still further object of the present inventions is to provide a rocking ornament in which the supporting shaft is mounted with a sleeve member between the rocking member and the tray so as to prevent the rocking member from colliding the recess portion of the tray upon swaying.

DETAILED DESCRIPTION OF THE PREFERRED EMBODIMENT

Figure 1:
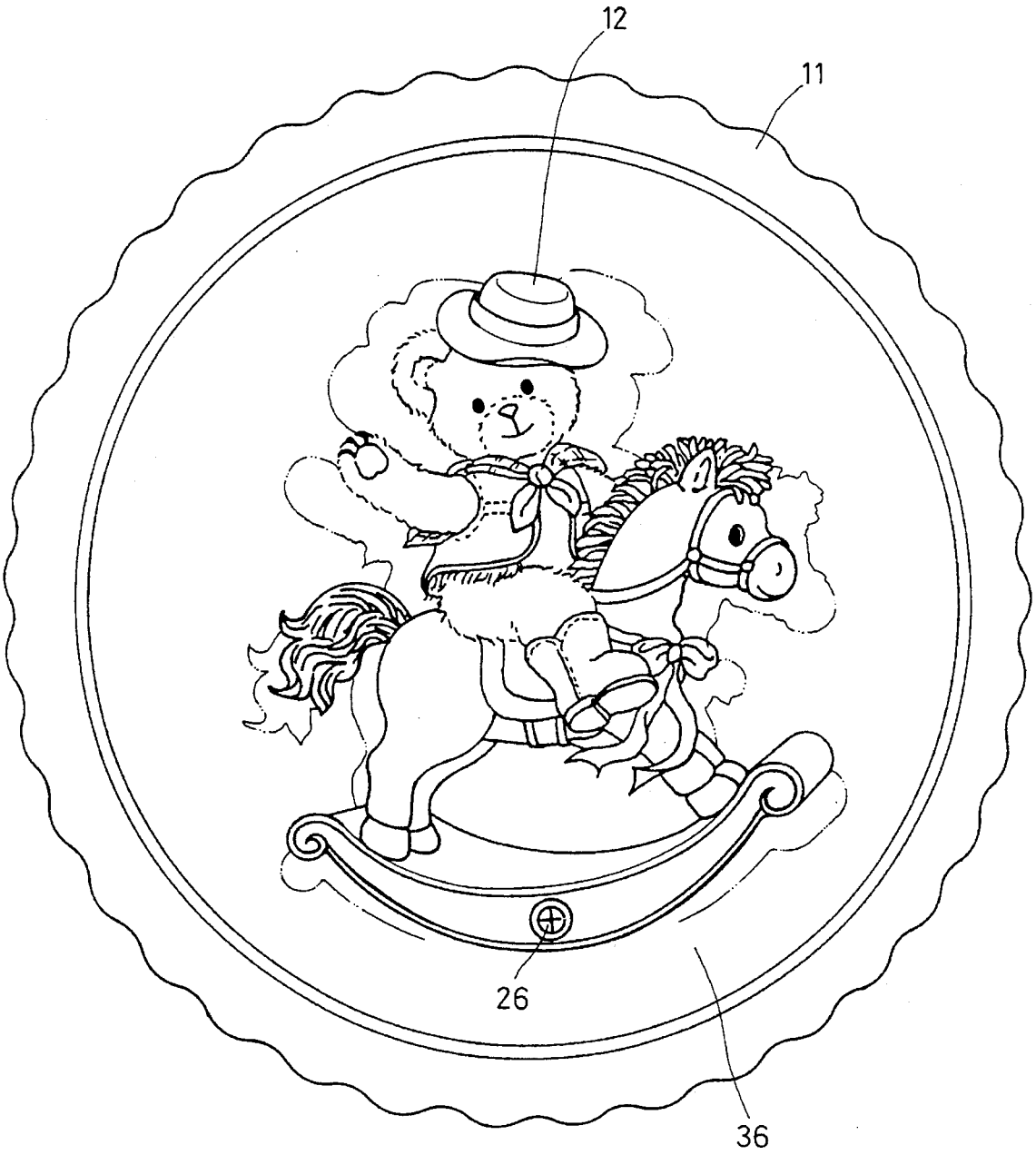
FIG. 1 is a plan view, showing a rocking member in the tray to sway back and forth.
Figure 2:
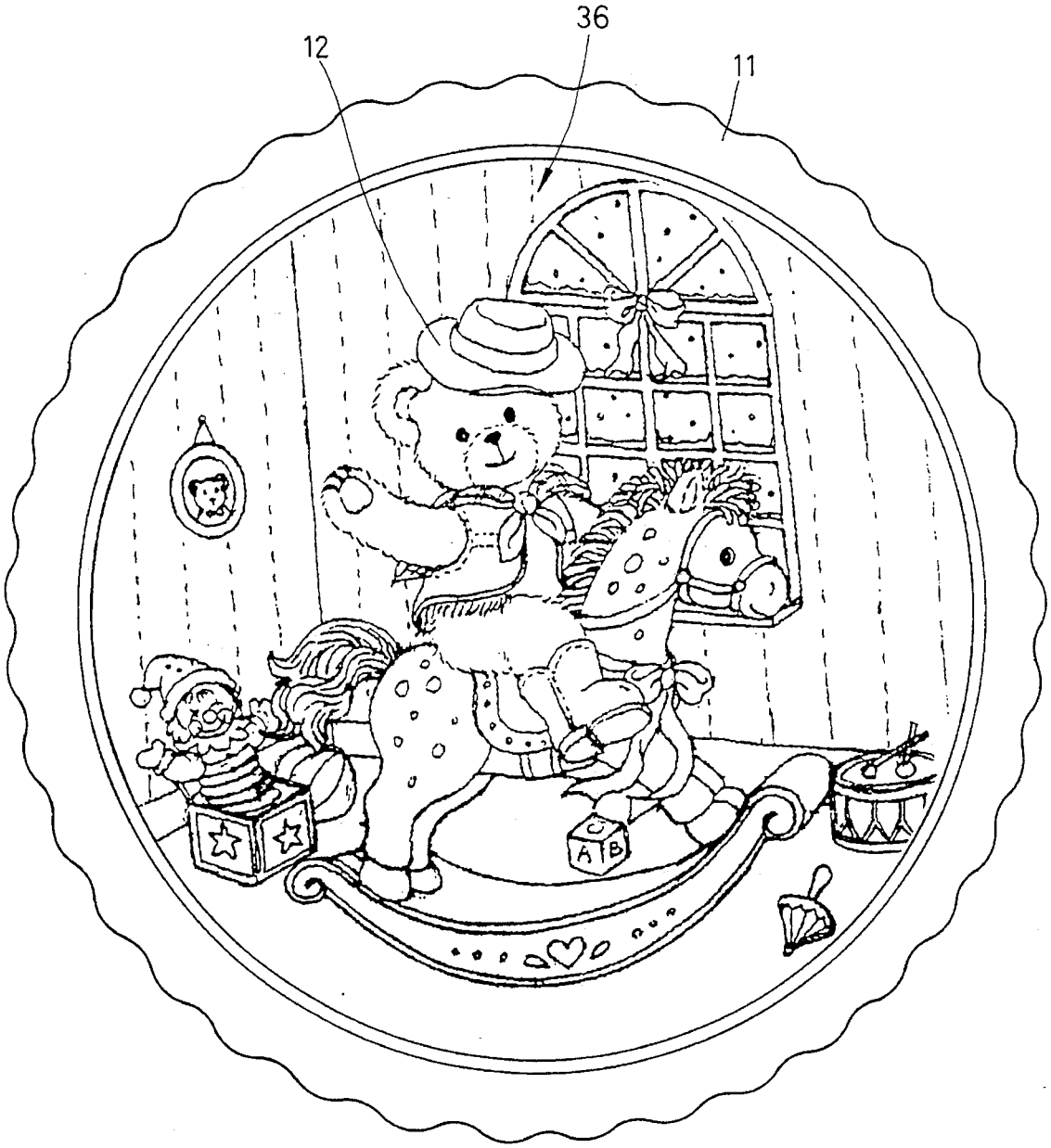
FIG. 2 is a plan view, showing a rocking ornament mounted in a tray.

Referring to FIGS. 1 and 2, the present invention comprises a tray 11, of which the recess portion 36 is provided with an ornamental pattern; the recess portion 36 is also mounted with an ornamental rocking member 12, of which the lower end is furnished with a screw spindle; the back side center of the rocking member is connected with a rocking mechanism. The rocking mechanism can move circularly upon the music box playing music so as to actuate the rocking member 12 to rock leftwards and rightwards.

As shown in FIGS. 1 to 5, the tray 11 is substantially a disc-shaped member, but it can also be designed into a square member or other suitable shapes. The recess portion 36 of the tray 11 has an ornamental pattern (a printed or a painted pattern) or a relief pattern. The center of the recess portion 36 has a hole 38 in communication with a mechanism chamber 23.

The mechanism chamber 23 behind the tray 11 is used to mount a music device and a transmission device therein; the music device is substantially a music box 13 with a related transmission assembly for transmitting the mechanical power for the rocking member 12. The music device may be an electronic device being furnished with additional motor, and gears as a retarding device. As shown in the figure related, the music box 13 and the transmission device are fixedly mounted on a base plate 14, which covers the opening of the mechanism chamber 23 on the back of the tray 11. The upper edge of the base plate 14 is furnished with a lug 37 to facilitate the tray 11 to be hung on a wall. The mechanism chamber 23 includes a battery chamber 24, a music device and a transmission device; the transmission device has a spindle 18 extended through a hole 38 in the tray 11, and to connect with a connecting shaft of an eccentric wheel 19.

As shown in the aforesaid Figs., the music box 13 is to be operated by means of a motor 40 to drive a retarding gear train, which is coupled with a drum member 41; the drum member 41 is provided with a plurality of beads to play a plurality of music reeds for producing sound; simultaneously, transmission gears 16 beside the drum member 41 will engage with a driven gear 17 on the frame member 15;

the driven gear 17 is pivotally mounted on the frame member 15 by using a spindle 18; the other end of the spindle 18 extends through the hole 38 in the tray 11 to connect with the eccentric wheel 19. When the music box 13 rotates, the transmission gear 16 beside the drum member 41 will drive the driven gear 17 to turn. The driven gear 17 will through the spindle 18, transmit a driving force to the eccentric wheel 19 outside the hole 38; a stud 20 on the eccentric wheel 19 can move circularly to drive the rocking member 12 to sway leftwards and rightwards.

Figure 3:
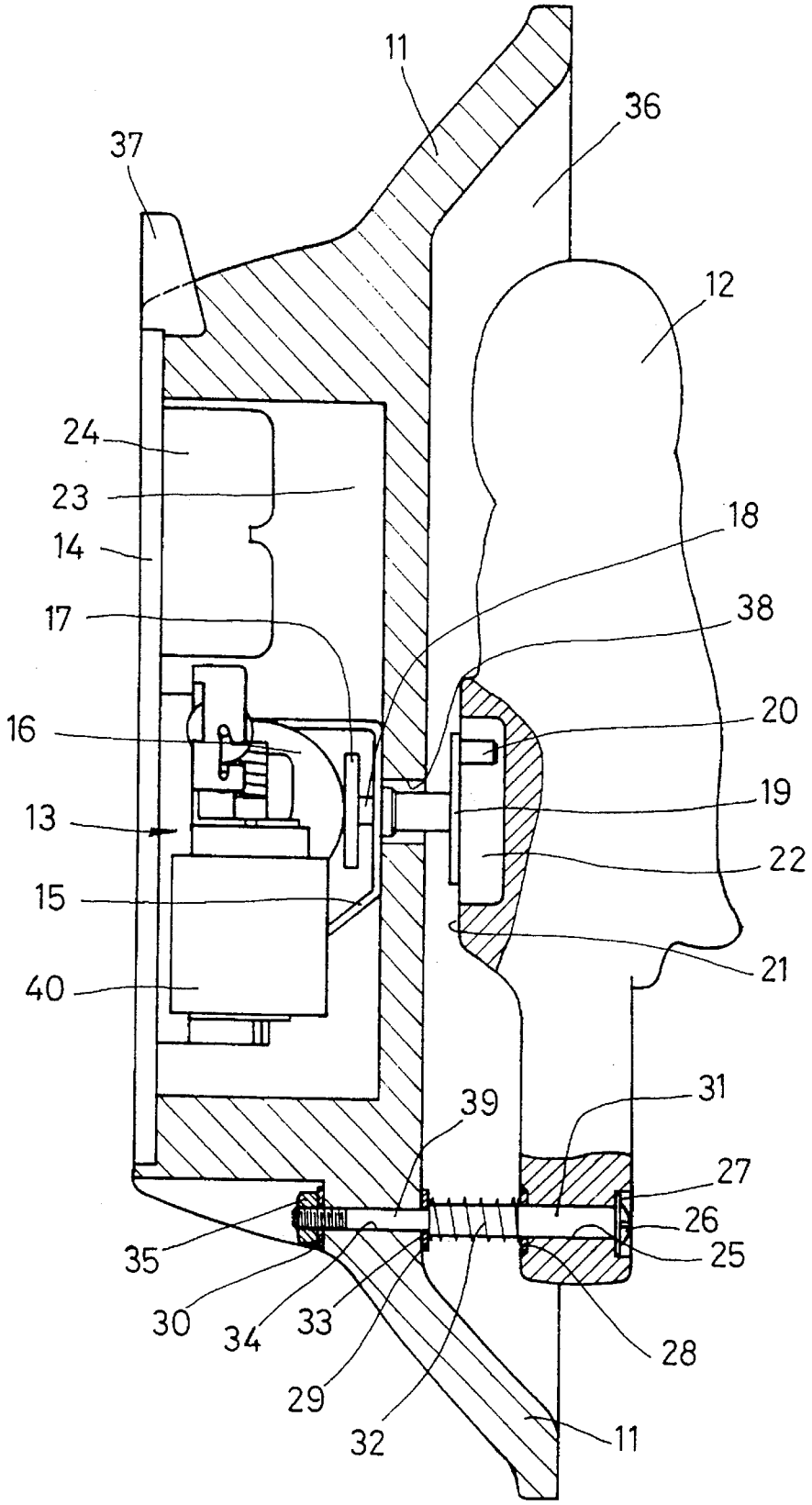
FIG. 3 is a sectional view, showing the spindle relation between the tray and the rocking member.
Figure 4:
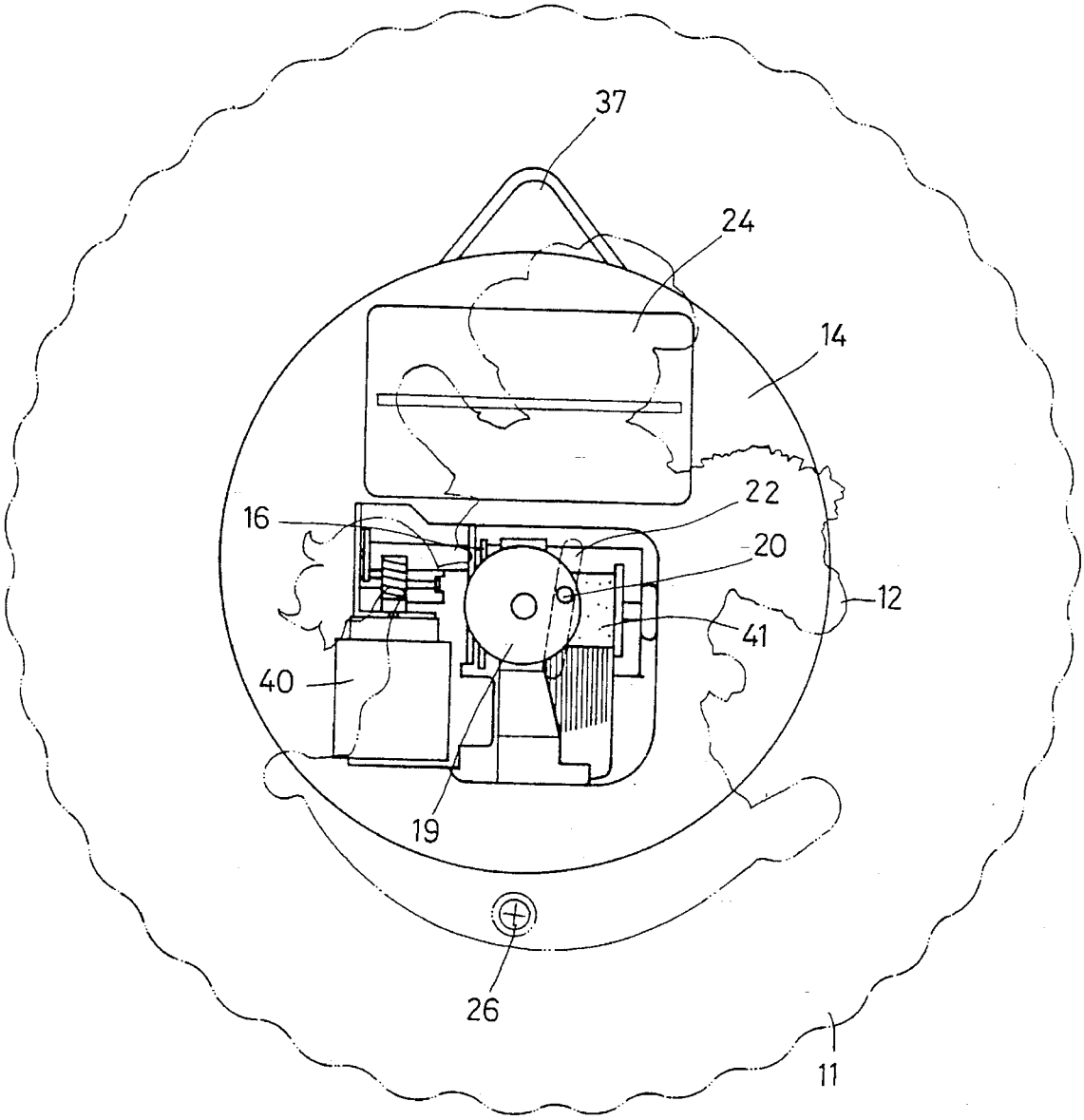
FIG. 4 is a plan view, showing the transmission structure of an eccentric wheel.
Figure 5:
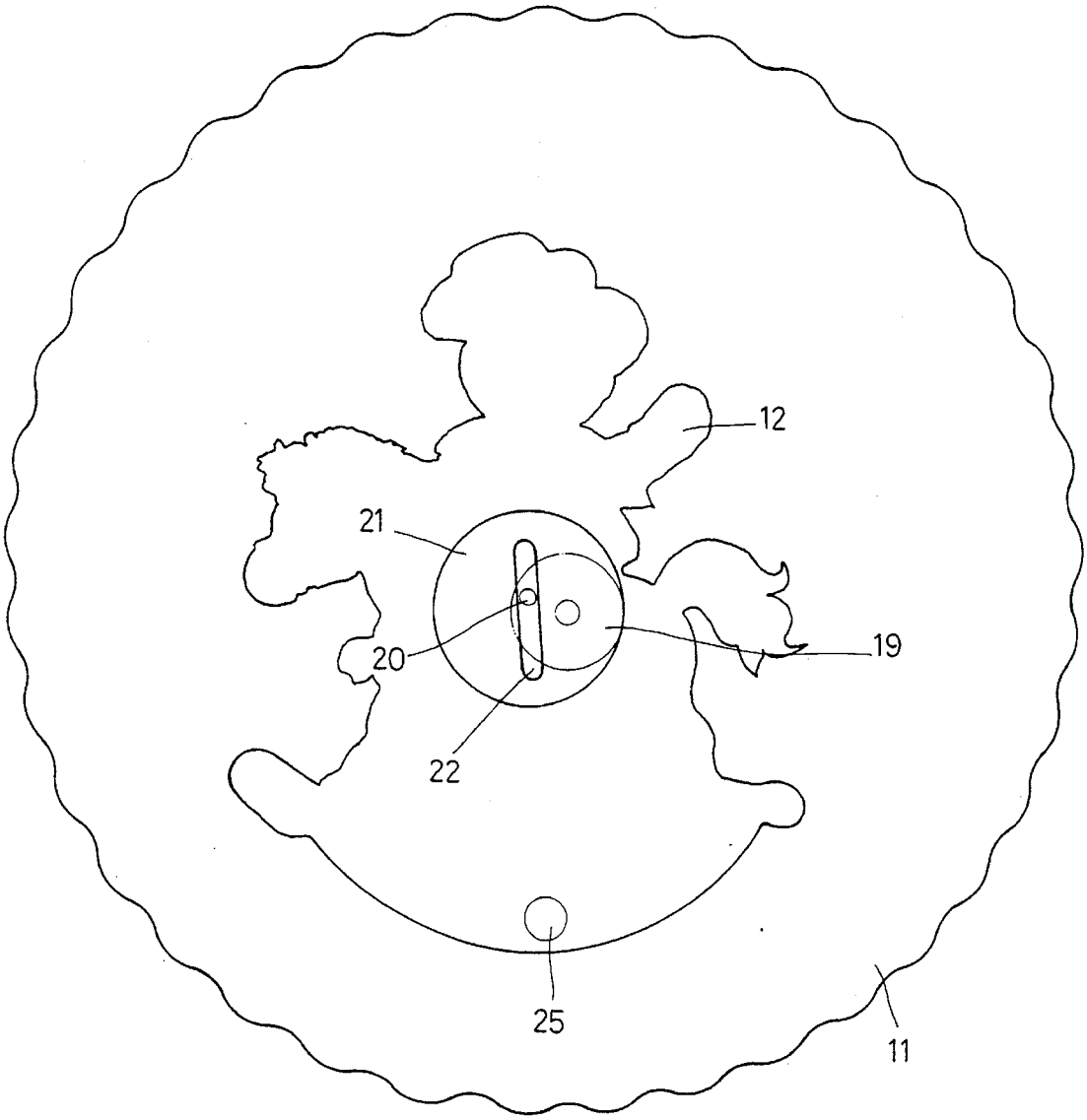
FIG. 5 is a plan view, showing an elongate slot behind the rocking member.

The rocking member 12 mounted in the recess portion 36 of the tray 11 can be designed into a horse, a rocking chair or other forms; the back of the rocking member 12 and the recess :portion 36 are separated with a short space so as to prevent the rocking member 12 from colliding with the bottom surface of the recess portion 36, and also to provide a suitable space for mounting the eccentric wheel 19. As shown in FIGS. 3 and 5, the back of the rocking member 12 to be in contact with the eccentric wheel 19 has a round seat 21 with an elongate slot 22 in longitudinal direction. The depth and width of the slot 22 are equal to or slightly larger than the length and diameter of the stud 20 on the eccentric wheel 19; the length of the slot 22 is larger than the outer diameter of the eccentric wheel 19. The elongate slot 22 is used for mounting the stud 20 therein; when the eccentric wheel 19 rotates, the stud 20 will move circularly to actuate the rocking member 12 to sway leftwards and rightwards.

Figure 6:
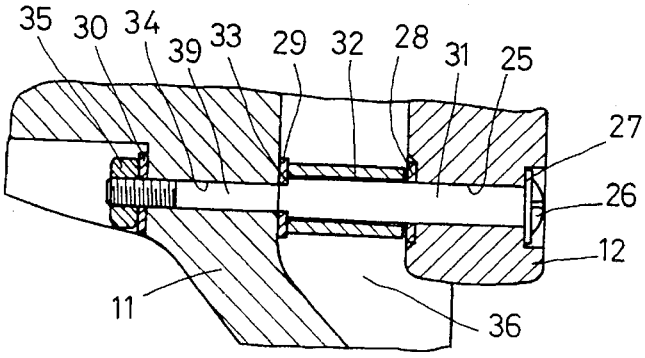
FIG. 6 is a fragmental section view, showing a shaft structure between the tray and the rocking member.

Referring to FIG. 3, the lower part of the rocking member 12 has a through hole 25 for filing a screw spindle 26 of the shaft 31. The screw spindle 26 before passing through the through hole 25 is mounted with a washer 27; after the screw spindle 26 passing through the through hole 25, a washer 28 is mounted thereto on the other end of the through hole 25. After the shaft 31 of the screw: spindle 26 passes through the through hole 25, it extends at a given length to form into a smaller round shaft 39 in terms of diameter to pass through a through hole 34 in the tray 11. The connected part of the shaft 31 and the round shaft forms into a stair-shaped portion 33, which is mounted with a washer 29 for limiting the length of the screw spindle 26 upon passing through the through hole 34. The lower end of the screw spindle 26 is mounted with a washer 30 to be fixed in place with a nut 35. The screw spindle 26 is mounted in place by means of the washer 29 on the stair-shaped portion 33, i.e., the screw spindle 26 is positioned exactly in the through hole 34 of the tray 11 so as to provide a stable rocking condition for the rocking member 12. In order to prevent the rocking member 12 from colliding with the recess surface of the tray 11 upon the rocking member 12 swaying, a sleeve member 32 is mounted between the through hole 25 and the through hole 34. The length of the sleeve member 32 is related to the distance between the elongate slot 22 in the rocking member 12 and the stud 20 on the eccentric wheel 19 so as to prevent collision upon the rocking member 12 swaying. As shown in FIG. 3, the sleeve member 32 is mounted between the washer 28 and the washer 29, and it is substantially a spring. As shown in FIG. 6, the sleeve member 32 is substantially a short bushing mounted between the rocking member 12 and the tray 11 so as to prevent the rocking member 12 from collision with the tray 11.

The rocking member 12 is supported with the shaft 31, which is positioned with the two washers 27 and 28. As a result of the limitation from the tray 11 and the sleeve member 12, the elongate slot 22 on the back of the rocking member 12 and the stud 20 on the eccentric wheel 19 are in contact with each other. In the music box 13, the motor 40 can drive the retarding device, which is coupled with a transmission gear 16 beside the drum member 41; the transmission gear 16 engages with a driven gear 17, which can transmit a force, through the spindle 18, to the eccentric wheel 19 outside the hole 38; the stud 20 on the eccentric wheel 19 can move circularly along the elongate slot 22 on the back of the rocking member 12, and then the rocking member 12 can rock laterally and regularly.

The embodiment of the present invention has been described in detail to disclose the features and structure thereof; it is apparent that the present invention has shown the improvement thereof, which is never anticipated and accomplished by others so far; the structure of the present invention is deemed unique.

I claim:

1. A rocking ornament in a tray comprising:

a tray having a recess portion with an ornamental pattern on a forward surface a rocking member mounted in said recess portion; back side of said tray having a mechanism chamber and a through hole between said back side and said forward surface of said tray; said mechanism chamber being closed with a base plate;

said base plate being substantially a flat plate with a lug on upper edge and said base plate having a battery chamber, a music device driven by a motor through and a transmission device; said transmission device having a spindle extended through said hole in said tray with said spindle connected to an eccentric wheel;

said eccentric wheel being furnished with a stud engaged in an elongate slot on back side of said rocking member;

said rocking member being ornament and with a back side and elongate slot with depth and length on said back side, said rocking member having a through hole on a lower part, and a shaft of a screw spindle mounted through said through hole;

said screw spindle having a shaft on one end, and said shaft mounted in said through hole of said rocking member, while an other end of said shaft is formed into a round shaft passing through a through hole on a lower edge of said tray, and being mounted with a nut on said other end thereof; and a sleeve member mounted on said shaft in said through hole of said rocking member.

2. A rocking ornament in a tray as claimed in claim 1, wherein said ornamental pattern in said recess portion of said tray is a printed pattern on a painted pattern.

3. A rocking ornament in a tray as claimed in claim 1, wherein said ornamental pattern is a relief pattern.

4. A rocking ornament in a tray as claimed in claim 1, wherein said music device and said transmission device in said mechanism chamber include a retarding gear train and a drum member; said drum member being provided with a plurality of beads, and a plurality of music reeds in contact with said beads to produce sound; a transmission gear beside said drum member engaged with a driven gear mounted on a frame member; said spindle of said driven gear pivotally mounted on said frame member with said spindle extended into and through said hole in said tray.

5. A rocking ornament in a tray as claimed in claim 1, wherein said music device and said transmission device in said mechanism chamber include an electronic device fixedly mounted on said base plate; said transmission device includes a motor and a gear train mounted on said base plate; said transmission device having a spindle extended into said hole in said tray.

6. A rocking ornament in a tray as claimed in claim 1, wherein said round seat on back of said rocking member has an elongate slot facing said eccentric wheel; depth and width of said elongate slot being equal to or slightly larger than length and diameter of said stud on said eccentric wheel; length of said elongate slot being larger than outer diameter of said eccentric wheel; and said elongate slot for receiving said stud on said eccentric wheel.

7. A rocking ornament in a tray as claimed in claim 1, wherein said screw spindle as a shaft for said rocking member has a larger diameter shaft passing through said through hole to extend into said through hole in said tray, and said extended portion as a round shaft having a smaller diameter, and end of said round shaft being fastened in place with a nut; a stair-shaped portion being furnished between said two shafts having different diameters, and a washer mounted thereto to push against outer surface of said through hole in said tray.

8. A rocking ornament in a tray as claimed in claim 1, said sleeve member mounted on said shaft under said rocking member is a spring to space said rocking member from said surface of said tray.

9. A rocking ornament in a tray as claimed in claim 1, wherein said sleeve member mounted on said shaft under said rocking member is substantially a short bushing to prevent from collision between said rocking member and surface of said tray.

* * * * *